United States Patent [19]

Hippel

[11] Patent Number: 4,765,005

[45] Date of Patent: Aug. 23, 1988

[54] SUPPORT DEVICE

[76] Inventor: George H. Hippel, P.O. Box 23515, Fort Lauderdale, Fla. 33307

[21] Appl. No.: 40,294

[22] Filed: Apr. 20, 1987

Related U.S. Application Data

[63] Continuation-in-part of Ser. No. 835,174, Mar. 3, 1986, abandoned.

[51] Int. Cl.[4] ..... A47C 20/02; A47C 21/00

[52] U.S. Cl. ..... 5/443; 5/445; 5/508

[58] Field of Search ..... 5/443–445, 5/508; 24/130; 272/138, 900

[56] References Cited

U.S. PATENT DOCUMENTS

| | | | |
|---|---|---|---|
| 3,574,900 | 4/1971 | Emery | 24/130 |
| 3,902,731 | 9/1975 | Fagen et al. | 5/123 X |
| 4,120,077 | 10/1978 | Fink | 24/130 |

FOREIGN PATENT DOCUMENTS

| | | | |
|---|---|---|---|
| 615986 | 1/1917 | France | 5/444 |
| 11082 | 7/1915 | United Kingdom | 5/444 |

*Primary Examiner*—Michael F. Trettel

[57] ABSTRACT

The foot support system includes an adjustable foot support easily attachable to a bed or other personal support, for aiding persons in maintaining a sitting position while in bed on a mattress surface or other personal support. The foot support system includes an elongated foot support such as a hollow elongated tubular element, a rope and a releasable jam cleat for adjusting the effective length of the rope to position the foot support at various positions in relation to the person using the feet support system. The rope is positioned around the back of the headboard of the bed or fixed in relationship to a back support to adjustably position the foot support at various distances from the front of the headboard or the back support.

5 Claims, 2 Drawing Sheets

SUPPORT DEVICE

BACKGROUND OF THE INVENTION

This is a continuation-in-part of now abandoned application Ser. No. 835,174, filed Mar. 3, 1986. The prior art cited in the prior application do not include the claimed subject matter.

FIELD OF THE INVENTION

This invention relates to an adjustable feet contacting system for aiding persons to maintain a sitting position on a bed or on a personal support thereby preventing the person from slipping down from a sitting position. A sitting person is supported from slipping down to an undesirable lower position with the person's trunk moved toward the foot of the support and away from the back support.

DESCRIPTION OF THE PRIOR ART

The prior art discloses many devices for permitting a person while in bed to maintain a sitting position or to push himself back up from an inclined or supine position toward the bed's headboard. The devices used are footboards, for example, as disclosed in U.S. Pat. No. 4,240,170.

SUMMARY OF THE INVENTION

This invention relates to a static device easily attachable to a backboard of a bed or other personal back support and adjustable in relation to the back support, and more particularly, to a device for aiding a person to maintain a sitting position while in bed, particularly during reading, taking meals, watching television, or other activities requiring a sitting position.

The novel features of this invention reside in a device including four essential components. One, a hollow elongated foot support such as a hollow elongated tubular element constructed of a lightweight material. Two, a rope or line having two ends. Three, a releasable fastening device with three functions, first for adjusting the effective length of the rope to position the foot support at various positions in relation to the person using the feet contacting system, second, for quickly releasing the rope, third, for maintaining the rope in an accessable position, and four, a rope securing means to maintain the rope around a headboard of a bed.

OBJECTS OF THE INVENTION

The primary object of the invention is in a system of non-complex construction, for attachment to a bed or a personal support for maintaining a person in a sitting position against a back support and varying the person's leg positions.

Another object of the invention is in a foot supporting system for a person sitting in bed or against a personal support which is easily adjustable by the person.

Still another object of the invention is in a device with only four basic parts that are used to maintain a person in a sitting position and requires little effort to connect the device to a bed.

Still other objects of the invention will be readily apparent to those skilled in the art in light of the following detailed description of the invention.

A further object of this invention is the rope loop placed around a back support to hold the assembled device in, on or around a bed in a fixed position without bolts, buckles, clamps, hooks, screws, straps or adhesives.

In addition, the rope loop is easily used by dropping it over the headboard of a bed, the parallel ropes around the back of the backboard have sleeves to position the ropes. This allows the extending rope ends to lay on the mattress. The ropes on the mattress are pulled tight on both sides to firmly position the rope around the headboard and provide a noncomplex installation, eliminating bolts, buckles, clamps, hooks, screws, straps or adhesives.

BRIEF DESCRIPTION OF THE INVENTION

DETAILED DESCRIPTION OF THE INVENTION

Figure 1:
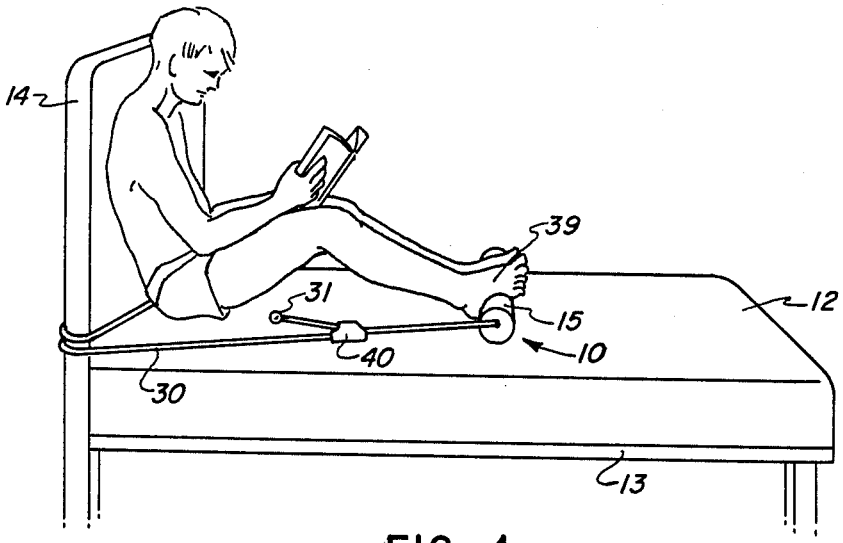
FIG. 1 is an illustration of a person in a bed using the novel foot supporting device, with the person in a sitting position with his legs proped up against a hollow tubular member and showing the line around the headboard of the bed.
Figure 2:
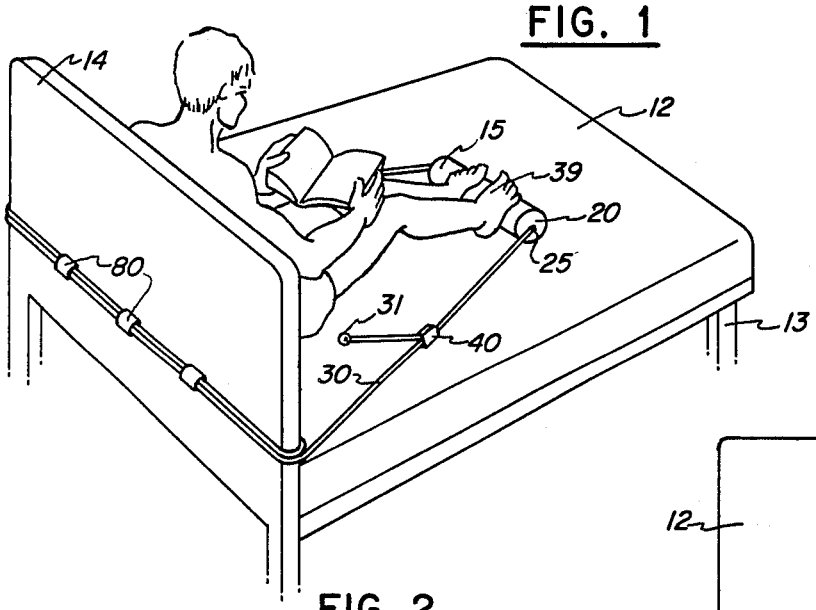
FIG. 2 is a rearward view as in FIG. 1 showing the line or rope around the back of the headboard of the bed.
Figure 3:
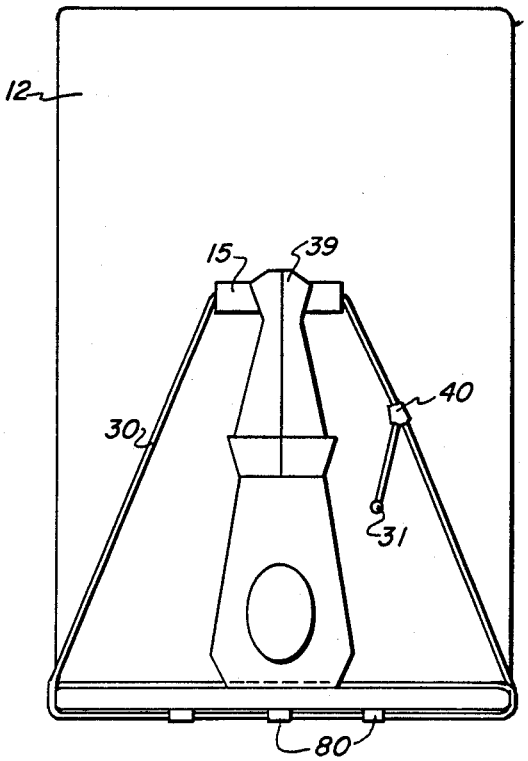
FIG. 3 is an illustration of a top view of a person using the device.

Referring generally to FIGS. 1, 2 and 3 numeral 10 represents the novel foot support system of the invention for preventing a person from sliding from a sitting position to an inclined or supine position in a bed 12 having a headboard 14 and bed frame 13. The foot support system may be used on other furniture, as chairs or on other supporting surfaces or even on a floor to position the user in relation to a back support or vertical post. The support system includes a foot support, such as a hollow tubular member 15, lightweight in construction, preferably formed from a PVC tube or other material, like metal, paper or wood.

Figure 5:
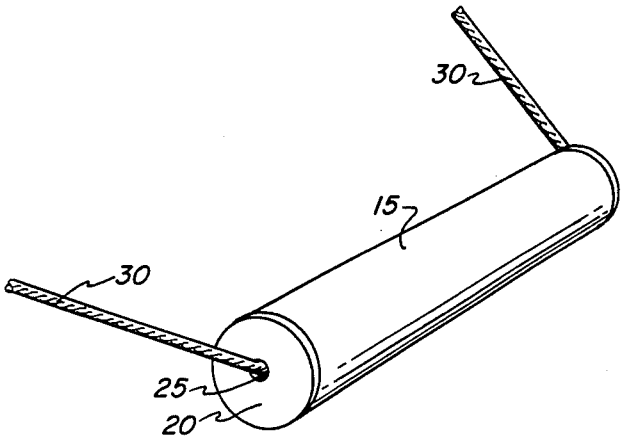
FIG. 5 illustrates the foot support member in the form of a hollow tube.
Figure 6:
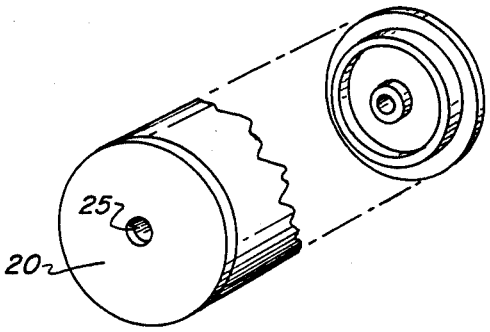
FIG. 6 illustrates the foot support member partially broken away.

The tubular member 15 may be cylindrical in cross-section, as shown in FIGS. 5 and 6 or octagonal, not shown or of other polygonal cross-sections or other shapes. The member 15 is of sufficient strength and length, for example, about twenty (20) inches long, and of sufficient diameter, for example, about two and three-fourth ($2\frac{3}{4}$) inches for comfortably supporting the soles of a person's feet as shown in FIGS. 1, 2 and 3. The rope 30 in FIGS. 1, 2 and 3 may be approximately 21 feet long.

Figure 7:
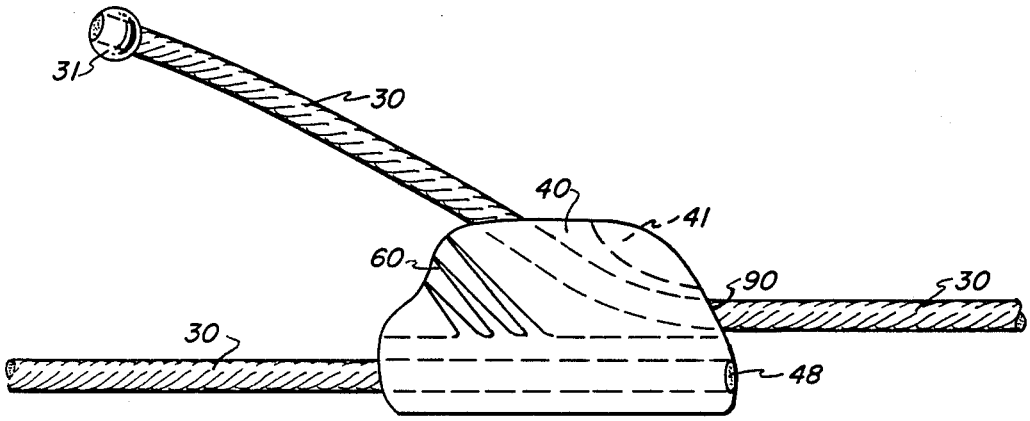
FIG. 7 is a side view illustrating the jam cleat showing a preferred embodiment in which one end of the line or rope is permanently embedded in the jam cleat.
Figure 8:
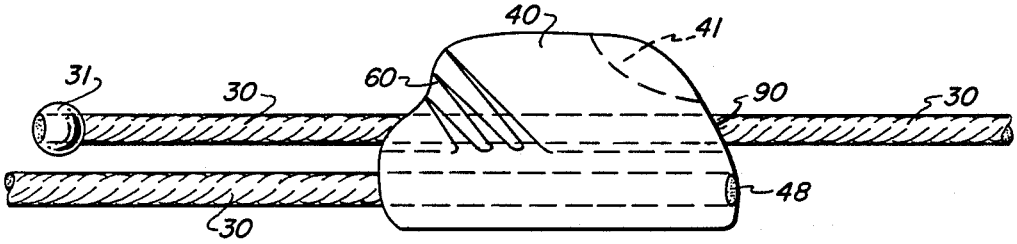
FIG. 8 is another side view of the jam cleat shown in FIG. 7.
Figure 9:
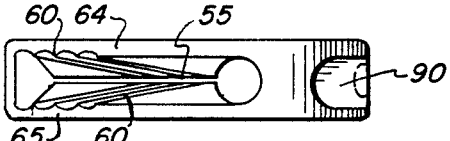
FIG. 9 is a top view of the jam cleat.
Figure 10:
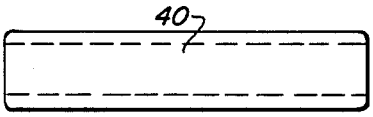
FIG. 10 is a bottom view of the jam cleat.
Figure 11:
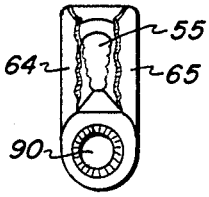
FIG. 11 is a rear view of the jam cleat.
Figure 12:
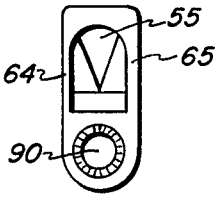
FIG. 12 is a front view of the jam cleat.

Tubular member 15 includes end closures 20 having apertures or holes 25 of sufficient diameter to receive a rope 30. The rope runs smoothly and freely into either end of tube 15 and easily through the tube 15 during adjustment. The tubular member 15 has a smooth outer surface. The tubular member 15 is freely adjustable on the rope 30. The rope 30 moves tubular member 15 back and forth across the bed in relation to the back support 14 and may be moved along the line or rope 30 to the right or left on the bed to position the tubular member in the right place. User adjusts the tubular member 15 into the right place on the bed (from the sides) for the particular user and adjusts the tubular member 15 to a desired distance from the back support 14. A length of rope 30 is initially pulled through and threaded through an opening in the jam cleat as shown in FIG. 7 prior to attaching the knob 31. In use, the excess length of rope or line 30 with the knob 31 on it is pulled through the jam cleat 40. The jam cleat 40 has a bridge 41 over the opening through the jam cleat. A portion of the rope 30 moves through the opening 90 in the jam cleat 40 shown in FIGS. 7 through 12. The user places at least one foot 39 against tubular member 15 and pushes to position the tubular member 15 on the bed and then the user locks the rope 30 by dropping it into groove 55 in the jam cleat 40.

One end of the rope 48 is firmly embedded in the jam cleat 40. The other end (with knob) serves as length adjuster and is movable through opening 90.

The rope 30 is held around the backboard 14 as shown in FIGS. 1, 2 and 3. The rope 30 first passes around the backboard at 30' and through the holding sleeves 80 and around the front of the backboard at 30'' and again around the rear of the backboard 14 at 30''' generally parallel to the first portion of the rope at 30'. The rope passes through the three sleeves 80 and is pulled tight so that the whole assembled unit will henceforth stay in an easily, adjustable position on the mattress surface. The rope 30 emerges from one side of the backboard and continues through the tubular member 15 and is then feed back to the jam cleat 40. The rope 30 emerges from the other side of the backboard into the jam cleat 40 shown in FIGS. 1, 2 and 3.

The knobbed end 31 of the rope is adjustably fed and securedly held in a jam cleat designated by numeral 40. The up or down movement of the rope adjacent the knob 31 will disconnect or connect the rope in jam cleat 40. The jam cleat has a bridge 41 of solid construction over opening 90 and a pair of spaced side elements 64 and 65 secured to lower section 66 in such a manner as to define a downwardly tapered slot or groove 55 therebetween shown in FIG. 11 and 12. The distance across the top is larger than distance across the bottom of the groove. The inner sides of each side of the jam cleat 40 include a plurality of spaced grooves 60 extending from an upper right position in FIG. 8 of the sides to the bottom left thereof and are closely spaced to form wavelike surface or a gripping surface for frictionally engaging and gripping the jammed rope in a well known manner. The grooves 60 are located about forty-five degrees from the horizontal. The width of the slot at the top is about one-half ($\frac{1}{2}$) inch and about one-eight ($\frac{1}{8}$) inch at the bottom thereof. One end of the rope 30 is embedded in jam cleat 40.

The jam cleat body may be shaped as shown in the Figures and has a body 40. This shape may further assist the user to hold the jam cleat in the user's hand when tightening or loosening the rope.

Figure 4:
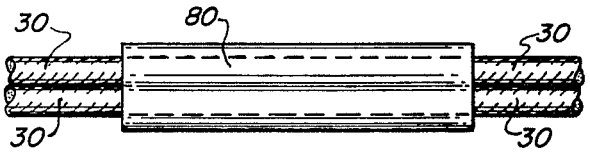
FIG. 4 is a side view illustrating the line or rope support means.

The sleeves 80 are illustrated in FIG. 4 and includes a generally oval or round shaped tube with an opening that allows two portions of the rope to pass through the opening. The jam cleat 40 and the sleeves 80 may be formed of any material, preferably PVC type plastic or similar material.

After installation of the member 15, it will lie on the bed mattress or on a flat surface. The user sits up in bed. The user then firmly holds in his right hand the jam cleat 40, pulls the rope end (with knob 31) with the other hand to move the member 15 towards himself. Whereupon his feet will make contact with the member 15 positioning his knees in a desired position. Next he must pull the loose rope from the foot end in the direction towards the jam cleat 40 and drop a portion of the rope in upper groove 55 of jam cleat 40. A gentle pressure against the foot support member 15 will automatically aid in jamming or locking the rope in the jam cleat 40. The extra length of the rope adjacent knob 31, now idle, rests on the mattress surface pointing towards the headboard.

The tubular member 15 may be covered with soft material for foot comfort.

The rope may be one quarter of an inch thick. The rope may be a nylon rope.

The member or tube 15 may include a heater having an electrical connection for connection to a power source. The heater may be electrical coils that may be heated to approximately 100 degrees. A built-in vibrator may also be used instead of a heater or in addition to the heater to stimulate blood circulation in the user's feet.

It should be noted that the member 15 and rope with jam cleats can be used on either side of the bed. The rope must be long enough to be pushed out of the way to the side or to the end of mattress, so the user can stretch out his body to rest or sleep.

It is evident from the above disclosures that modifications of the invention are within the scope thereof without departing from the spirit of the invention or sacrificing the principle advantages thereof.

What is claimed is:

1. A foot contacting support system for use on a support surface for maintaining a person in a propped-up, sitting position in relation to a back support, said system comprising:

a rope means having two ends;

a foot support means of sufficient length and width for contact with at least one foot of the person, said foot support means having a long outer shape surrounding a through channel extending from a first end to a second end, said rope means adjustably connected through said channel of said foot support means, said foot support means movably freely over said rope means, said rope means positionable transversley across the support surface for use by the person sitting on the support surface to support by foot contact the person in a sitting position adjacent the back support;

said rope means connected around the back support, and a fast acting releasable jam cleat fastener means fixed to one end of said rope means, said fast acting jam cleat fastener means including a generally V-shaped jam cleat means for receiving a portion of said rope means for adjusting and releasably connecting the effective length of said rope means, said rope means for assisting in adjusting the location of said foot support means in relation to the back support;

said fast acting jam cleat fastener means having a generally V-shaped rope connecting portion, V-shaped portion having a base below said V-shaped jam cleat means, said V-shaped jam cleat means having upper ends spread apart for recieving said rope means.

2. A foot contacting support system as recited in claim 1, wherein:

said fast acting jam cleat fastener means includes a bridging member connected between said upper ends.

3. A foot contacting support system as recited in claim 1, wherein:

said foot support means is a hollow tube member with two end pieces having rope apertures for allowing said rope means to pass freely through said foot support means.

4. A foot contacting support system for use on a support surface for maintaining a person in a propped-up, sitting position in relation to a back support, said system comprising:

(a) a rope means having two ends;

(b) a foot support means of sufficient length and width for contact with at least one foot of the person, said foot support means adjustably connected on said rope means for use by the person sitting on the support surface to support the person in a sitting position adjacent the back support;

(c) said rope means connected around the back support, and (d) a releasable fastener means connected to one end of said rope means, said fastener means including a jam cleats for adjusting the effective length of the other end of said rope means for assisting in adjusting the location of said foot support means in relation to the back support;

said jam cleat having a generally V-shaped rope connecting portion, said V-shaped portion having a base and upper ends;

said rope means having a length to pass around the back support one and one-half times, at least one sleeve means positioned around two portions of said rope means positioned on the rear side of the back support and lying generally parallel to one another;

said sleeve means for supporting said two portions of said rope means around the back of said back support for preventing said two portions of said rope means from dropping lower than said support surface.

5. An adjustable foot contacting system for use by a person sitting on a support surface for maintaining the person in a sitting propped-up position against a back support, said system comprising:

(a) a foot engaging means for contact with the bottom of the feet of the person for use by the person to maintain a sitting position on the support surface and against the back support, said foot engaging means having two ends, said foot engaging means including a long channel therethrough, (b) a rope means adjustably connected through said two ends and passing freely through said channel, said rope means having one portion positioned adjacent to and encircling the back support, said rope means of a length sufficient to allow movement of said foot engaging means toward and away from the back support; and (c) a releasable jam cleat means connected to one end of said rope means, said releasable jam cleat means including a V-shaped gripping means for adjusting the effective length of said rope means for assisting in locating said foot engaging means spaced from the back support at a desired distance to support the person in a sitting position but at a distance no greater then about equal to the length of the torso and the legs of the person;

said jam cleat means having at least one end of said rope means fixed therein and having a second portion of said rope means adjustably connectable to said V-shaped gripping means of said jam cleat means, said V-shaped gripping means of said jam cleat means including means for frictionally receiving another portion of the other end of said rope means for maintaining said member in fixed position.

* * * * *